US008343021B1

(12) United States Patent
Seraydarian et al.

(10) Patent No.: US 8,343,021 B1
(45) Date of Patent: Jan. 1, 2013

(54) EXERCISE APPARATUS

(76) Inventors: Grant Seraydarian, Niagara Falls, NY (US); Varsenick Seraydanan, Niagara Falls, NY (US)

( * ) Notice: Subject to any disclaimer, the term of this patent is extended or adjusted under 35 U.S.C. 154(b) by 0 days.

(21) Appl. No.: 13/447,225

(22) Filed: Apr. 15, 2012

(51) Int. Cl.
*A63B 71/00* (2006.01)

(52) U.S. Cl. ..... 482/141; 482/142; 482/148

(58) Field of Classification Search ..... 482/108, 482/141, 142, 148
See application file for complete search history.

(56) References Cited

U.S. PATENT DOCUMENTS

| | | | | | |
|---|---|---|---|---|---|
| 3,341,196 | A | | 9/1967 | Perretta | 482/45 |
| D264,738 | S | | 6/1982 | Cooper | D21/679 |
| D272,649 | S | | 2/1984 | Bloch | D24/211 |
| 4,496,147 | A | | 1/1985 | DeCloux et al. | |
| D285,329 | S | | 8/1986 | Boettger, Jr. | D21/684 |
| D287,867 | S | | 1/1987 | Wollersheim | D21/681 |
| 5,181,897 | A | * | 1/1993 | Agan | 482/141 |
| 5,284,458 | A | | 2/1994 | Perry et al. | 482/49 |
| 5,316,531 | A | | 5/1994 | Spence | 482/93 |
| 5,328,431 | A | | 7/1994 | Winslow | 482/106 |
| D354,100 | S | * | 1/1995 | Tsay et al. | D21/686 |
| D358,856 | S | | 5/1995 | Boettger, Jr. | D21/684 |
| 5,466,206 | A | | 11/1995 | Fleming | |
| D365,861 | S | | 1/1996 | Moss et al. | D21/679 |
| 5,527,252 | A | * | 6/1996 | Sather | 482/141 |
| 5,716,305 | A | | 2/1998 | Selsam | |
| 5,749,818 | A | * | 5/1998 | Sather | 482/141 |
| D395,210 | S | | 6/1998 | Almsig | D7/701 |
| 5,839,996 | A | | 11/1998 | Gooding | 482/106 |
| 6,190,293 | B1 | | 2/2001 | Schuyler et al. | |
| D451,564 | S | | 12/2001 | Dean | D21/684 |
| D456,864 | S | | 5/2002 | Dantolan | D21/684 |
| D533,413 | S | | 12/2006 | Wax | D7/701 |
| D544,554 | S | | 6/2007 | Brun | D21/680 |
| D546,402 | S | | 7/2007 | Sonnier | D21/662 |
| D556,841 | S | | 12/2007 | Oates | D21/679 |
| D579,990 | S | | 11/2008 | Dalcourt | D21/680 |
| D610,637 | S | | 2/2010 | Ford | D21/684 |
| 7,976,443 | B2 | * | 7/2011 | Krull | 482/108 |
| D657,830 | S | | 4/2012 | Guarrasi | D21/662 |
| 2011/0009250 | A1 | | 1/2011 | Barringer | |

* cited by examiner

*Primary Examiner* — Glenn Richman
(74) *Attorney, Agent, or Firm* — Richard L. Miller

(57) ABSTRACT

A pair of identical pushup exercise devices that replaceably engage on a same pair of adjacent cove molds of a staircase simultaneously, and are separate and spaced-apart from each other so as to accommodate users of different upper body structures. The pair of identical pushup exercise devices are identical to each other, are separate from each other, and are spaced-apart from each other for accommodating the users of different upper body structures. Each identical pushup exercise device includes a rod. The rod of each identical pushup exercise device replaceably engages on the same pair of adjacent cove molds of the staircase simultaneously, and is gripped by the users of different upper body structures to perform a pushup exercise.

8 Claims, 5 Drawing Sheets

EXERCISE APPARATUS

1. BACKGROUND OF THE INVENTION

A. Field of the Invention

The embodiments of the present invention relate to an exercise device, and more particularly, the embodiments of the present invention relate to a pair of identical pushup exercise devices for replaceably engaging on a same pair of adjacent cove molds of a staircase simultaneously, and for being separate and spaced-apart from each other so to accommodate users of different upper body structures.

B. Description of the Prior Art

Numerous innovations for exercise devices have been provided in the prior art, which will be described below in chronological order to show advancement in the art, and which are incorporated in their entirety herein by reference thereto. Even though these innovations may be suitable for the specific individual purposes to which they address, nevertheless, they differ from the present invention in that they do not teach a pair of identical pushup exercise devices for replaceably engaging on a same pair of adjacent cove molds of a staircase simultaneously, and for being separate and spaced-apart from each other so to accommodate users of different upper body structures.

(1) U.S. Pat. No. 4,496,147 to DeCloux et al.

U.S. Pat. No. 4,496,147 issued to DeCloux et al. on Jan. 29, 1985 in U.S. class 482 and subclass 53 teaches apparatus that simulates the exercise obtained while climbing stairs, which includes two hydraulically phased steps retained in adjacent inclined tracks in which the steps are supported in a hydraulically open-ended system, with the phasing of the steps being controlled by a pair of in-line hydraulic actuators, one each associated with a step, in which fluid forced from one actuator with a downward movement of the associated step is channeled through a variable restricted orifice to the other actuator to raise the other step. In one embodiment, the device is collapsed down to a compact size through the use of steps that are foldable to the track, and through the use of a track foldable to the frame. In its open position, the lower portion of the frame props up the track at an appropriate climbing angle, with upper portions of the frame extending above the track to serve as handles positioned above the center of travel of the steps.

(2) U.S. Pat. No. 5,466,206 to Fleming.

U.S. Pat. No. 5,466,206 issued to Fleming on Nov. 14, 1995 in U.S. class 482 and subclass 141 teaches exercise aids for doing inclined pushups, which may be positioned on the top of an elevated surface, e.g., a table top. The handle bar of each aid is held in one hand and the person plants the bottom of the feet on the floor and does the pushup. The aid has a handle bar that is inclined at an angle of about 30°±5° with respect to the bottom surface of the aid that supports it to permit back and forth push up type motion.

(3) U.S. Pat. No. 5,716,305 to Selsam.

U.S. Pat. No. 5,716,305 issued to Selsam on Feb. 10, 1998 in U.S. class 482 and subclass 93 teaches a multiple use exercise device that is formed as a closable and hollow container that may be filled with a ballast substance, such as water, by the end user. The hollow container is penetrated at each end by a recess. The central portion of each recess is spanned by a handle giving the device utility as a barbell. A central cutout, shaped to accommodate the trunk of the user, enhances this utility by making the container easier for the user to hold close to the body, and by increasing the range of motion possible at full extension and contraction, during exercises normally performed with a barbell. A flat surface, located on the side of the container opposite the central cutout, serves as a stepping surface for the performance of stair stepping type exercises. A pair of voids, penetrating the container from the central cutout to the flat stepping surface, are shaped to accept the insertion of the user's feet from either the top or the bottom. When the feet are inserted from the bottom, the device exerts a downward force on them, facilitating the performance of sit-ups or leg extensions. When the feet are inserted from the top, they are elevated and anchored as a fulcrum for the enhanced performance of push-ups.

(4) U.S. Pat. No. 5,749,818 to Sather.

U.S. Pat. No. 5,749,818 issued to Sather on May 12, 1998 in U.S. class 482 and subclass 141 teaches an exercise apparatus and method for exercising, which utilize a conventional staircase to provide varying degrees of inclination during push-up exercises. The exercise apparatus is specifically adapted for use on a conventional staircase so that it reduces rocking while performing push-up exercises. The level of difficulty of the push-up exercises is varied by placing the exercise apparatus at one of the plurality of elevations along the staircase, thereby allowing different users of different physical capabilities to perform push-up exercises with the same apparatus.

(5) U.S. Pat. No. 6,190,293 to Schuyler et al.

U.S. Pat. No. 6,190,293 issued to Schuyler et al. on Feb. 20, 2001 in U.S. class 482 and subclass 141 teaches an exercise apparatus that allows for adjustments in height, and optionally width between hand grips, while maintaining an ergonomic grip that is substantially parallel to the user's body, regardless of the adjustment used.

(6) United States Patent Application Publication Number 2011/0009250 to Barringer.

United States Patent Application Publication Number 2011/0009250 published to Barringer on Jan. 13, 2011 in U.S. class 482 and subclass 141 teaches a torso push-up assistance device for assisting a user in performing push-ups. The torso push-up assistance device includes a base component, a torso support component rotationally attached to the base component, and an elastic system that connects the base component to the torso support component in one or more optional configurations. In a first embodiment, the elastic system includes a set of one or more pairs of matched elastic bands that removably connect the rear end of the torso support component to the rear end of the base component. The user lies on the torso support component with his or her feet on the floor, and does push-ups in the usual way. Depending on the configuration of the matched elastic bands installed on the torso pushup assistance device, the user's effort varies from a small percentage to a large percentage of the force required to do an unassisted push-up.

It is apparent that numerous innovations for exercise devices have been provided in the prior art, which are adapted to be used. Furthermore, even though these innovations may be suitable for the specific individual purposes to which they address, nevertheless, they would not be suitable for the purposes of the embodiments of the present invention as heretofore described, namely, a pair of identical pushup exercise devices for replaceably engaging on a same pair of adjacent cove molds of a staircase simultaneously, and for being separate and spaced-apart from each other so to accommodate users of different upper body structures.

2. SUMMARY OF THE INVENTION

Thus, an object of the embodiments of the present invention is to provide a pair of identical pushup exercise devices for replaceably engaging on a same pair of adjacent cove molds of a staircase simultaneously, and for being separate and spaced-apart from each other so to accommodate users of different upper body structures, which avoids the disadvantages of the prior art.

Briefly stated, another object of the embodiments of the present invention is to provide a pair of identical pushup exercise devices that replaceably engage on a same pair of adjacent cove molds of a staircase simultaneously, and being separate and spaced-apart from each other so as to accommodate users of different upper body structures. The pair of identical pushup exercise devices are identical to each other, are separate from each other, and are spaced-apart from each other for accommodating the users of different upper body structures. Each identical pushup exercise device includes a rod. The rod of each identical pushup exercise device replaceably engages on the same pair of adjacent cove molds of the staircase simultaneously, and is gripped by the users of different upper body structures to perform a pushup exercise.

The novel features considered characteristic of the embodiments of the present invention are set forth in the appended claims. The embodiments of the present invention themselves, however, both as to their construction and to their method of operation together with additional objects and advantages thereof will be best understood from the following description of the specific embodiments when read and understood in connection with the accompanying figures of the drawing.

3. BRIEF DESCRIPTION OF THE FIGURES OF THE DRAWING

The figures of the drawing are briefly described as follows.

Figure 4:
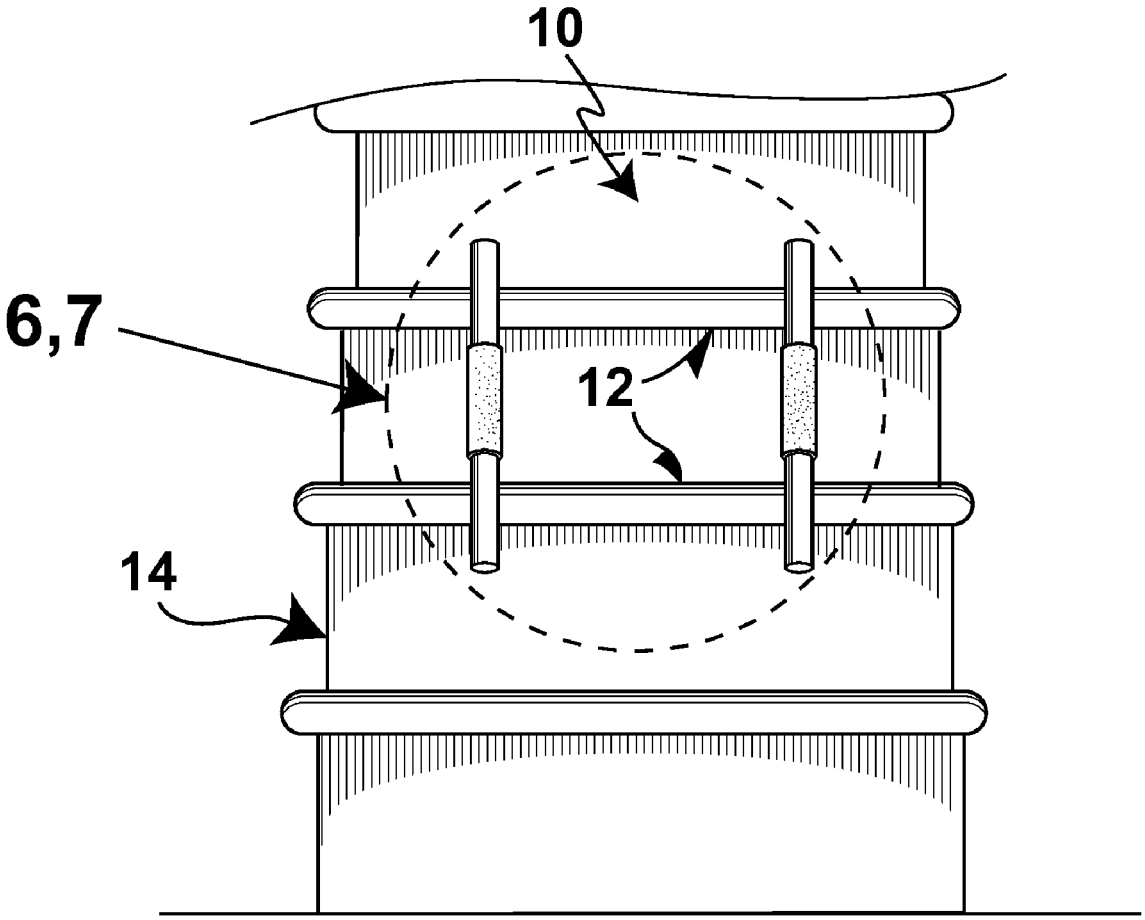
FIG. 4 is a reduced diagrammatic front elevational view taken generally in the direction of ARROW 4 in FIG. 3.
Figure 6:
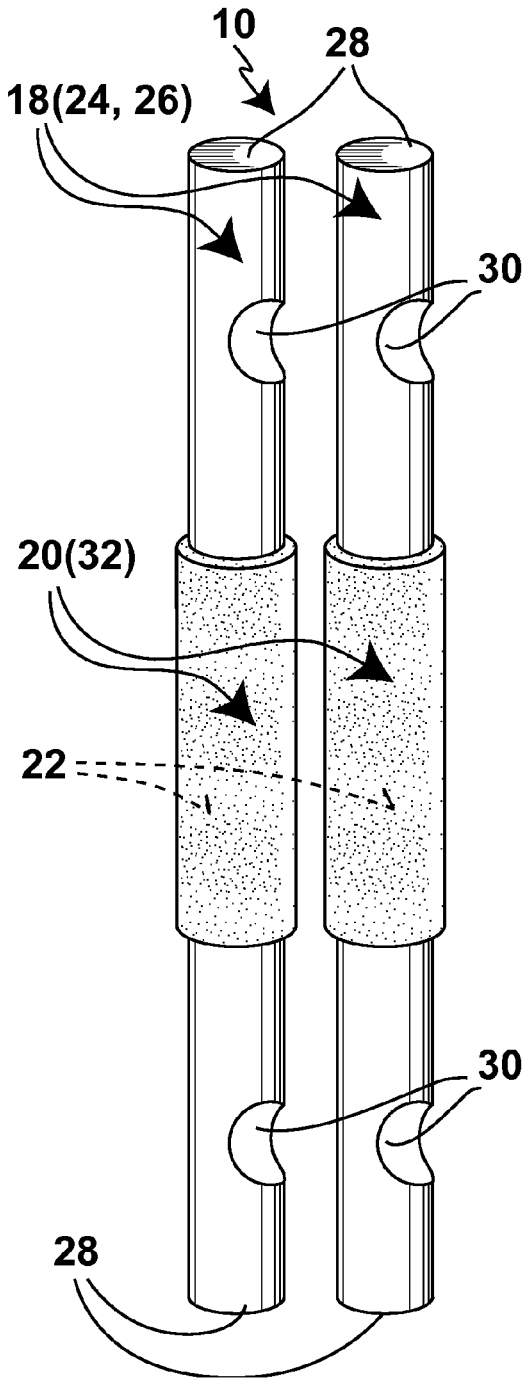
Figure 7:
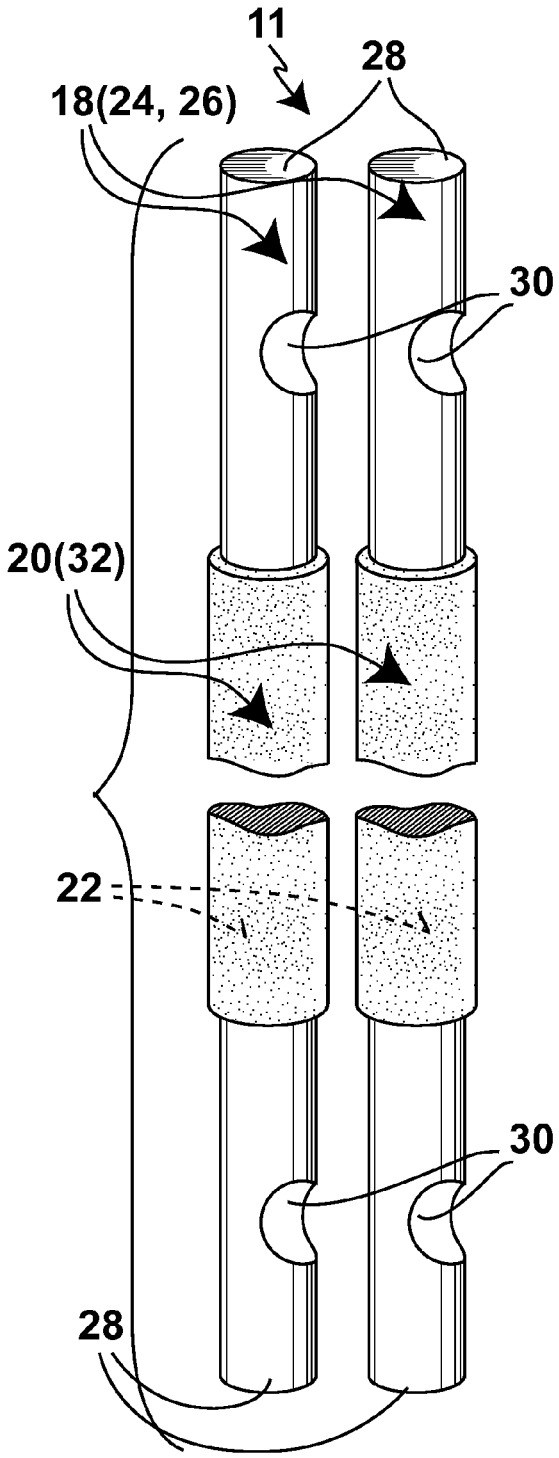

FIG. 6 is an enlarged diagrammatic perspective view of the area generally enclosed by the dotted curve identified by ARROW 6 in FIG. 4 of the pair of identical pushup exercise devices of the embodiments of the present invention; and FIG. 7 is an enlarged diagrammatic perspective view of the area generally enclosed by the dotted curve identified by ARROW 7 in FIG. 4 illustrating various lengths of the pair of identical pushup exercise devices of the embodiments of the present invention.

4. LIST OF REFERENCE NUMERALS UTILIZED IN THE FIGURES OF THE DRAWING

A. Introductory 10 pair of identical pushup exercise devices of embodiments of present invention for replaceably engaging on same pair of adjacent cove molds 12 of staircase 14 simultaneously, and for being separate and spaced-apart from each other so to accommodate users 16 of different upper body structures 12 pair of adjacent cove molds of staircase 14

14 staircase 16 users

B. Configuration of Pair of Identical Pushup Exercise Devices 10

18 rod of each identical pushup exercise device of pair of identical pushup exercise devices 10 for replaceably engaging on same pair of adjacent cove molds 12 of staircase 14 simultaneously, and for being gripped by users 16 of different upper body structures to perform pushup exercise 20 grip of each identical pushup exercise device of pair of identical pushup exercise devices 10

22 central portion of rod 18 of each identical pushup exercise device of pair of identical pushup exercise devices 10 for improving grip of users 16 of different upper body structures when performing pushup exercise 24 dowel of rod 18 of each identical pushup exercise device of pair of identical pushup exercise devices 10

26 hardwood dowel of dowel 24 of rod 18 of each identical pushup exercise device of pair of identical pushup exercise devices 10

28 pair of free ends of hardwood dowel 26 of dowel 24 of rod 18 of each identical pushup exercise device of pair of identical pushup exercise devices 10

30 pair of notches of hardwood dowel 26 of dowel 24 of rod 18 of each identical pushup exercise device of pair of identical pushup exercise devices 10 for replaceably engaging same pair of adjacent cove molds 12 of staircase 14 simultaneously 32 cushion grip of grip 20 of each identical pushup exercise device of pair of identical pushup exercise devices 10

5. DETAILED DESCRIPTION OF THE PREFERRED EMBODIMENTS

A. Introductory

Figure 1:
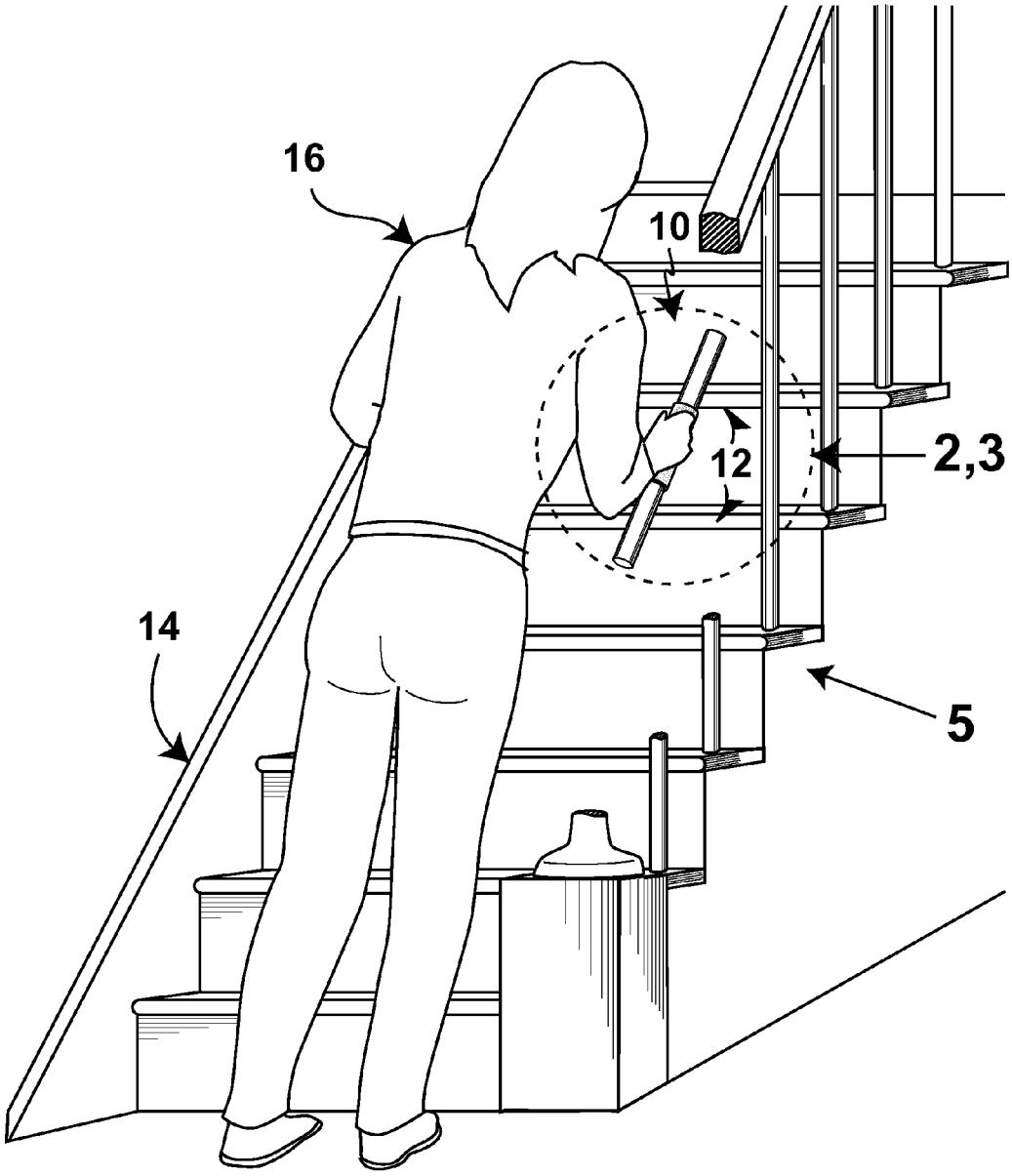
FIG. 1 is a diagrammatic perspective view of the pair of identical pushup exercise devices of the embodiments of the present invention replaceably engaging on a same pair of adjacent cove molds of a staircase simultaneously, and being separate and spaced-apart from each other so to accommodate users of different upper body structures.
Figure 2:
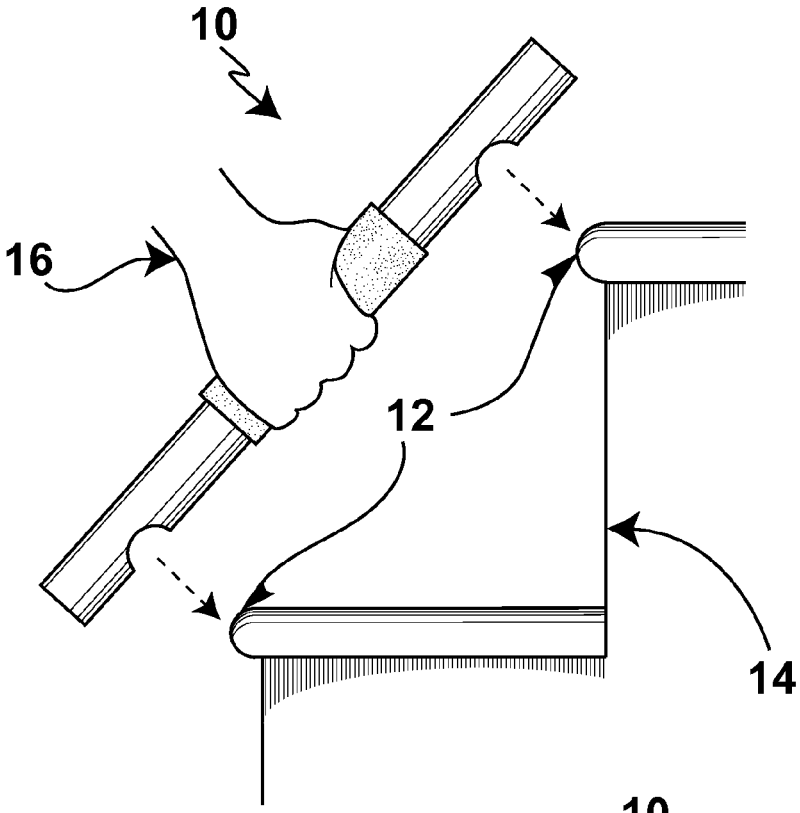
FIG. 2 is an enlarged diagrammatic side elevational view of the area generally enclosed by the dotted curve identified by ARROW 2 in FIG. 1.
Figure 3:
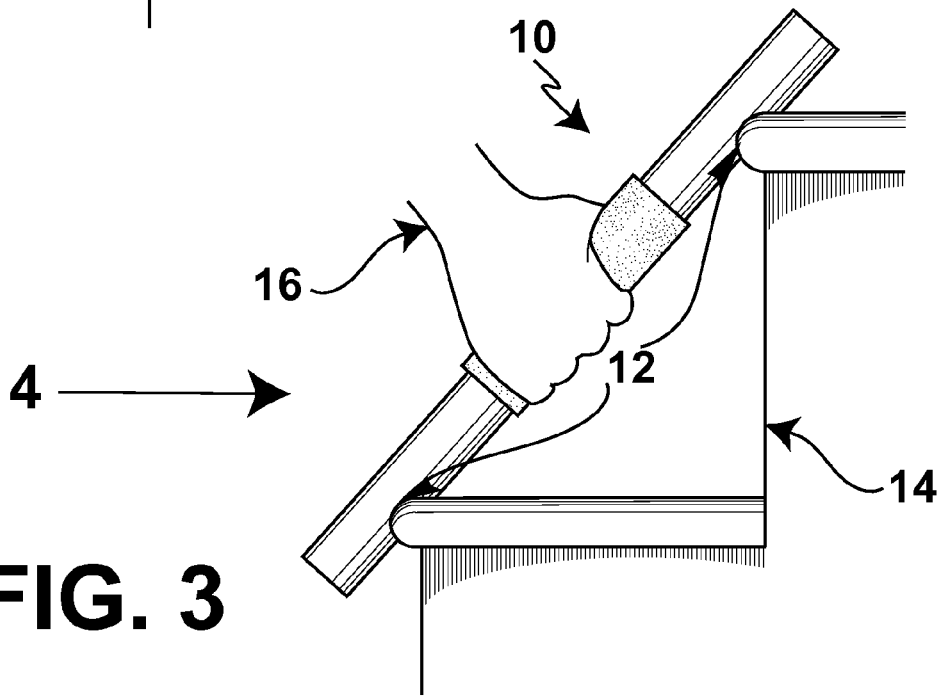
FIG. 3 is an enlarged diagrammatic side elevational view of the area generally enclosed by the dotted curve identified by ARROW 3 in FIG. 1.

Referring now to the figures, in which like numerals indicate like parts, and particularly to FIGS. 1-5, which are, respectively, a diagrammatic perspective view of the pair of identical pushup exercise devices of the embodiments of the present invention replaceably engaging on a same pair of adjacent cove molds of a staircase simultaneously, and being separate and spaced-apart from each other so to accommodate users of different upper body structures, an enlarged diagrammatic side elevational view of the area generally enclosed by the dotted curve identified by ARROW 2 in FIG. 1, an enlarged diagrammatic side elevational view of the area generally enclosed by the dotted curve identified by ARROW 3 in FIG. 1, a reduced diagrammatic front elevational view taken generally in the direction of ARROW 4 in FIG. 3, and a reduced diagrammatic side elevational view taken generally in the direction of ARROW 5 in FIG. 1, the pair of identical pushup exercise devices of the embodiments of the present invention is shown generally at 10 for replaceably engaging on a same pair of adjacent cove molds 12 of a staircase 14 simultaneously, and for being separate and spaced-apart from each other so to accommodate users 16 of different upper body structures.

B. Configuration of the Pair of Identical Pushup Exercise Devices 10

Figure 5:
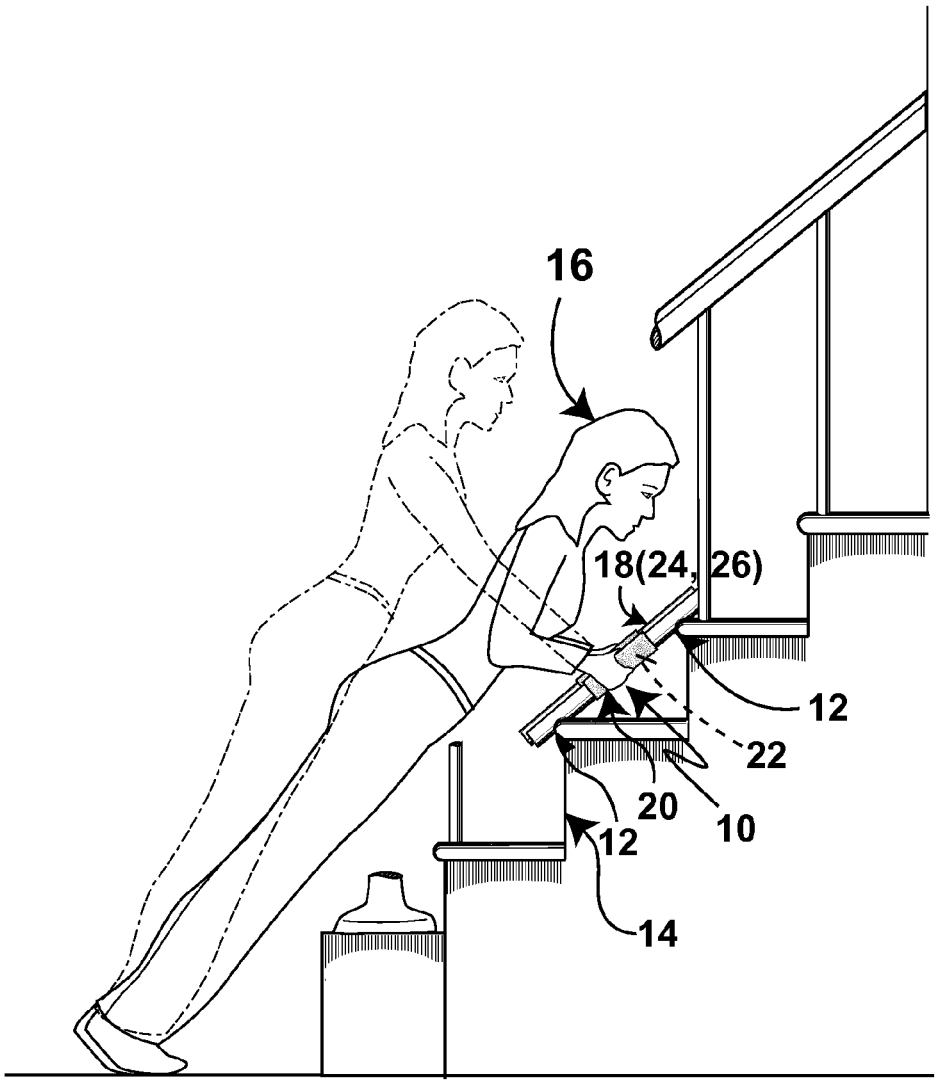
FIG. 5 is a reduced diagrammatic side elevational view taken generally in the direction of ARROW 5 in FIG. 1.

The configuration of the pair of identical pushup exercise devices 10 can best be seen in FIGS. 5-7, which are, respectively, again a reduced diagrammatic side elevational view taken generally in the direction of ARROW 5 in FIG. 1, an enlarged diagrammatic perspective view of the area generally enclosed by the dotted curve identified by ARROW 6 in FIG. 4 of the pair of identical pushup exercise devices of the embodiments of the present invention, and an enlarged diagrammatic perspective view of the area generally enclosed by the dotted curve identified by ARROW 7 in FIG. 4 illustrating various lengths of the pair of identical pushup exercise devices of the embodiments of the present invention, and as such, will be discussed with reference thereto.

The pair of identical pushup exercise devices 10 are identical, separate, and spaced-apart from each other for accommodating the users 16 of different upper body structures.

Each identical pushup exercise device 10 comprises a rod 18.

The rod 18 of each identical pushup exercise device 10 is for replaceably engaging on the same pair of adjacent cove molds 12 of the staircase 14 simultaneously, and for being gripped by the users 16 of different upper body structures to perform a pushup exercise.

Each identical pushup exercise device 10 further comprises a grip 20.

The grip 20 of each identical pushup exercise device 10 encircles a central portion 22 of the rod 18 of an associated identical pushup exercise device 10 for improving grip of the users 16 of different upper body structures when performing a pushup exercise (FIG. 5).

The rod 18 of each identical pushup exercise device 10 is a dowel 24.

The dowel 24 of the rod 18 of each identical pushup exercise device 10 is a hardwood dowel 26.

The hardwood dowel 26 of the dowel 24 of the rod 18 of each identical pushup exercise device 10 has a width of, preferably, approximately 1¼", and a length of, preferably, approximately 18" that is for being a bit longer than the distance between the same pair of adjacent cove molds 12 of the staircase 14.

The hardwood dowel 26 of the dowel 24 of the rod 18 of each identical pushup exercise device 10 further has a pair of free ends 28 and a pair of notches 30.

The pair of notches 30 of the hardwood dowel 26 of the dowel 24 of the rod 18 of each identical pushup exercise device 10 are disposed inwardly of the pair of free ends 28 of the hardwood dowel 26 of the dowel 24 of the rod 18 of an associated identical pushup exercise device 10, are, preferably, approximately 1⅜" in radii, are, preferably, approximately 12¾" spaced apart from each other, and are for replaceably engaging the same pair of adjacent cove molds 12 of the staircase 14 simultaneously.

The grip 20 of each identical pushup exercise device 10 is a cushion grip 32 that is, preferably, approximately 6" long.

C. Impressions

It will be understood that each of the elements described above or two or more together may also find a useful application in other types of constructions differing from the types described above.

While the embodiments of the present invention have been illustrated and described as embodied in a pair of identical pushup exercise devices for replaceably engaging on a same pair of adjacent cove molds of a staircase simultaneously, and for being separate and spaced-apart from each other so to accommodate users of different upper body structures, however, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A pair of identical pushup exercise devices for replaceably engaging on a same pair of adjacent cove molds of a staircase simultaneously, and for being separate and spaced-apart from each other so to accommodate users of different upper body structures, said devices comprising:

wherein said pair of identical pushup exercise devices are identical to each other;

wherein said pair of identical pushup exercise devices are separate from each other;

wherein said pair of identical pushup exercise devices are spaced-apart from each other for accommodating the users of different upper body structures;

wherein each identical pushup exercise device comprises a rod;

wherein said rod of each identical pushup exercise device is for replaceably engaging on the same pair of adjacent cove molds of the staircase simultaneously; and wherein said rod of each identical pushup exercise device is for being gripped by the users of different upper body structures to perform a pushup exercise; and wherein said rod of each identical pushup exercise device is a dowel.

2. The devices of claim 1, wherein said dowel of said rod of each identical pushup exercise device is a hardwood dowel.

3. The devices of claim 2, wherein said hardwood dowel of said dowel of said rod of each identical pushup exercise device has a length for being a bit longer than the distance between the same pair of adjacent cove molds of the staircase.

4. The devices of claim 2, wherein said hardwood dowel of said dowel of said rod of each identical pushup exercise device has:

a) a pair of free ends; and b) a pair of notches.

5. The devices of claim 4, wherein said pair of notches of said hardwood dowel of said dowel of said rod of each identical pushup exercise device are disposed inwardly of said pair of free ends of said hardwood dowel of said dowel of said rod of an associated identical pushup exercise device;

wherein said pair of notches of said hardwood dowel of said dowel of said rod of each identical pushup exercise device are spaced apart from each other; and wherein said pair of notches of said hardwood dowel of said dowel of said rod of each identical pushup exercise device are for replaceably engaging the same pair of adjacent cove molds of the staircase simultaneously.

6. The devices of claim 1, wherein said grip of each identical pushup exercise device is a cushion grip.

7. The devices of claim 1, further comprising a grip.

8. The device of claim 7, wherein said grip of each identical pushup exercise device encircles a central portion of said rod of an associated identical pushup exercise device; and wherein said grip of each identical pushup exercise device is for improving grip of the users of different upper body structures when performing a pushup exercise.

* * * * *

UNITED STATES PATENT AND TRADEMARK OFFICE

CERTIFICATE OF CORRECTION

PATENT NO. : 8,343,021 B1
APPLICATION NO. : 13/447225
DATED : January 1, 2013
INVENTOR(S) : Grant Seraydarian and Varsenick Seraydarian It is certified that error appears in the above-identified patent and that said Letters Patent is hereby corrected as shown below:

The text on the cover sheet reading:
(76) Inventors: Seraydarian; Grant (Niagara Falls, NY), Seraydanan; Varsenick (Niagara Falls, NY)

Is replaced by:
(76) Inventors: Seraydarian; Grant (Niagara Falls, NY), Seraydarian; Varsenick (Niagara Falls, NY)

Signed and Sealed this
Nineteenth Day of March, 2013

Teresa Stanek Rea
*Acting Director of the United States Patent and Trademark Office*